US005780189A

United States Patent [19]

Rider

[11] Patent Number: 5,780,189

[45] Date of Patent: Jul. 14, 1998

[54] APPARATUS AND METHOD FOR CONTROLLING THE CHEMICAL ACTIVITY OF PROCESSING SOLUTION IN A PHOTOGRAPHIC PROCESSING APPARATUS

[75] Inventor: Christopher Barrie Rider, Mitcham, England

[73] Assignee: Eastman Kodak Company, Rochester, N.Y.

[21] Appl. No.: 891,241

[22] Filed: Jul. 10, 1997

Related U.S. Application Data

[63] Continuation of Ser. No. 515,768, Aug. 15, 1995, abandoned, which is a continuation of Ser. No. 190,062, filed as PCT/EP92/01715, Jul. 29, 1992, abandoned.

[30] Foreign Application Priority Data

Aug. 1, 1991 [GB] United Kingdom ..... 9116625

[51] Int. Cl.[6] ..... G03C 5/02; G03D 3/00

[52] U.S. Cl. ..... 430/30; 430/398; 430/399; 430/400; 396/568; 396/569; 396/626

[58] Field of Search ..... 430/30, 398, 399, 430/400; 396/568, 569, 626

[56] References Cited

U.S. PATENT DOCUMENTS

| | | | |
|---|---|---|---|
| Re. 30,123 | 10/1979 | Crowell et al. | 137/624.15 |
| 3,554,109 | 1/1971 | Brady et al. | 396/569 |
| 3,559,555 | 2/1971 | Street | 396/569 |
| 3,828,172 | 8/1974 | Schickler | 364/500 |
| 4,310,234 | 1/1982 | Sakamoto et al. | 396/570 |
| 4,494,845 | 1/1985 | Aoki et al. | 396/578 |
| 4,577,950 | 3/1986 | Mackson | 396/632 |
| 4,603,956 | 8/1986 | Baker | 396/569 |
| 5,053,797 | 10/1991 | Samuels et al. | 396/622 |
| 5,518,845 | 5/1996 | Rider | 430/30 |

FOREIGN PATENT DOCUMENTS

| | | | |
|---|---|---|---|
| 0 381 502A1 | 2/1990 | European Pat. Off. . | |
| 1522884 | 10/1969 | Germany . | |
| 61-275757 | 12/1986 | Japan . | |
| 0 005 566 | 8/1978 | United Kingdom . | |
| 9107698 | 5/1991 | WIPO | 430/399 |
| WO 91/10940 | 7/1991 | WIPO . | |

OTHER PUBLICATIONS

*The Theory of the Photographic Process*, "Sensitometry of Color Films and Papers", Chapter 18, P. Kowaliski, MacMillan.

DP-1522884, Schumacher, English Translation.

JP-61-275757, Mori et al, English Translation.

*Primary Examiner*—Bernard P. Codd

*Attorney, Agent, or Firm*—Frank Pincelli

[57] ABSTRACT

In photographic processing apparatus, the processing solutions need to be replenished as they are used up. It is known to effect replenishment of chemicals in a paper processor by determining the amount of exposure given to the paper in the printing stage of such apparatus when copying an image on a filmstrip onto photographic paper, and using that information to calculate the amount of replenishment required to compensate exactly for the chemicals used up in processing that print. Described herein is a method of using data relating to the measured optical transmittance of an image on a filmstrip in the printing stage to control replenishment of the processing solutions in the film processing stage of the apparatus and also removal of image-dependent by-products produced in processing that filmstrip.

14 Claims, No Drawings

APPARATUS AND METHOD FOR CONTROLLING THE CHEMICAL ACTIVITY OF PROCESSING SOLUTION IN A PHOTOGRAPHIC PROCESSING APPARATUS

This is a continuation of application Ser. No. 08/515,768; filed Aug. 15, 1995, now abandoned, which is a continuation of Ser. No. 08/190,062; filed Jan. 28, 1994, now abandoned, which is a 371 of PCT EP92/01715, filed Jul. 29, 1992.

This invention relates to improvements in or relating to photographic processing.

In a photofinishing laboratory, one of the problems which must be overcome if quality standards are to be maintained concerns the drift in the sensitometry of processed photographic materials. One cause of such drift is incorrect replenishment of processing chemicals. As the chemicals in the processing baths are used up, replenishment chemicals must be added to keep the activities and concentrations of the chemicals constant.

Most modern film processors use sensors at their input to measure the area of film being processed. Replenishment may then be controlled assuming that the film has all been exposed to an average level. In actuality, if a film has received a greater than normal exposure such as might be the case for snow scenes or for bright sun, a greater amount of image-forming substance (silver for black-and-white materials, dyes for colour materials) than average would be produced on the film after development. In this case more replenishment than average would be required to correctly balance the chemical depletion in the processing solutions.

To maintain correct operating conditions in a processing machine, control strips are normally used at regular intervals. These strips are pieces of film exposed in a well-defined manner by the manufacturers. After processing, the optical density of the strips is measured using a densitometer and compared with the aim values. If the measured densities fall outside the control limits, appropriate action may be taken by the operator to bring the processor back to aim.

It is known in the industry to use the film scanner in a photographic printer to measure the optical density of the film control strips. The scanner has the prime function of measuring the transmittance of the film image to be printed. The scanner may have just one pixel in which case the average transmittance over the whole image is obtained, or it may have many pixels, yielding a more detailed profile of the transmittance of the image at many points. The scan will normally be in three colours for colour materials. From the scan data and stored sensitometric data relating to the print material, the printer calculates the exposure needed to form a correctly balanced copy of the film image.

It is also known that a scanner may be attached to the output end of black-and-white processors, especially for X-ray film, so that the density of developed silver may be measured and process control performed on the basis of a knowledge of the actual amount of silver produced after development.

In recent years, there has been a trend in the industry towards smaller automatic processing machines. Minilabs are small scale processing laboratories where the printer and paper processor are linked together in one unit with a separate film processor. More recently products have appeared where the film processor, printer and paper processor are integrated into one compact unit. As the machines become smaller, so solution volumes decrease and the possibility for errors in the assumption that all films are exposed to the average value increases. This leads to an increased likelihood that the process will diverge from aim values.

Two broad types of chemical reaction take place in a photographic process, namely:

(1) those which are in some way dependent on the amount of image formed on the exposed material; and (2) those which are independent of the amount of image formed on the exposed material.

Development is a good example of the first type of chemical reaction, and can be referred to as being "image-dependent". The amount of developer molecules used up in processing a piece of photographic material is related to the amount of latent image formed on it for given development conditions. Another example of an "image-dependent" chemical reaction is the bleaching process.

Fixing, on the other hand, is an example of an "image-independent" chemical reaction in colour photographic systems. All the silver in the photographic material is removed in a fixer bath and this amount is essentially the same regardless of the amount of exposure given to the material.

It should be noted, however, that in black-and-white systems, fixing is an image-dependent process in that the amount of undeveloped silver to be removed from the film by fixing is related to the amount of developed silver which remains. Unless otherwise stated, all subsequent discussion and examples will refer to the colour photographic process.

In addition, we may recognise two classes of chemical constituent of a seasoned process solution, namely:

a) those which are produced as a by-product of the reaction, such as halide ions or unreacted molecules of oxidized developer in the developer solution, and b) those which are depleted as a result of the reaction, such as the thiosulphate ion in the fixer.

The replenishment of chemicals which are depleted in a reaction which is "image-independent" may be accomplished by a measure of the area of the photographic material being processed. This is the case with fixers where all the silver is removed from the material and reacts with a fixing agent, for example sodium thiosulphate. Replenishment of the fixing agent in the fixer solution, is easily achieved by knowing what area of film or paper has been processed and the amount of silver per unit area of the material being processed. This technique is well-known in the industry and has been used for a long time.

Current industry practice for the replenishment of developers in processing apparatus is to use a signal derived solely from the area of material passing through the developer to control pumps metering the flow of developer replenisher from a holding tank into the developer bath. It is assumed that all material being developed has been exposed to the same average level. The replenisher system therefore adds D ml of developer replenisher per unit area of material passing through the developer, where D is an amount recommended by manufacturers from experience. This system gives satisfactory performance in processing apparatus with large tank volumes but performs less well in small tanks.

EP-A-0 381 502 describes a method of using scan data from a photofinishing printer to control the replenishment rate of the paper processor. In this method, the actual exposure given to the paper is inferred from measurements and the amount of depletion of the chemicals in processing the exposed paper is calculated. Exact replenishment of the depleted chemicals may then be effected. This technique does not require the use of sensors in the processor, except for currently measured variables such as temperature and time. It also overcomes the problems of small processing solution volumes as described above.

An extension of this concept is described in our copending patent application filed (U.S. Pat. No. 5,521,055, filed Feb. 1, 1994). In that application, a technique for controlling the subsystems employed for removing by-products from the processing reactions in photographic processors is disclosed. An example is given in which halide ions, released in proportion to the amount of silver developed on the film by the developer solution, may be calculated from a knowledge of the actual exposure given to the paper. From this calculation exact control of the subsystem for removing halide ions from the developer may be effected, thus maintaining a constant level of halide ions in the developer and hence maintaining the solution activity.

According to one aspect of the present invention, there is provided a method of controlling the chemical replenishment of processing solutions used in photographic processing apparatus comprising a film processing stage in which an exposed photographic film is processed and a subsequent second stage including measuring means for measuring the optical transmittance of an image on the film, the method including the step of measuring the transmittance of the image, characterized in that the measured transmittance information is used for converting the image into a desired format in that subsequent second stage and also for controlling the replenishment of processing solutions in the preceding film processing stage and its attached subsystems.

The phrase "converting the image into a desired format" refers to any process in which the image on the film is either reproduced on to a hard copy display medium, eg. photographic or thermal paper; or an electronic display means, such as, a cathode ray tube or a liquid crystal device; or sampled to enable the image to be stored in a storage device, eg. magnetic, electronic or optical storage media, or transmitted to a remote location.

Thus, in the case of minilabs, the present invention takes the data which is already available from the printer scanner for exposure determination purposes and uses it for another purpose, namely: the control of the replenishment of chemicals in the film processor.

It is actually simpler to calculate from the transmittance data produced by the printer scan, the amounts of dye (in the case of colour film) present in the film to be copied than to calculate the amounts of dye which will be produced in the copy print after it has been processed (for example, using the method described in EP-A-0 381 502).

A colour photographic material has three image forming layers: the cyan, magenta and yellow. These absorb light from the red, green and blue parts of the spectrum respectively. To a good approximation, the amounts of cyan, magenta and yellow dye present in a piece of colour film are linearly related to the logarithm of the transmittance (ie the optical density) of the film to red, green and blue light respectively. For many years, the photographic industry has used standardized equipment to measure the red, green and blue densities (status densitometry) of film for various applications including process control and exposure determination. Although there are small differences between the spectral transmittance of the dyes in different manufacturers' films, they are essentially the same, so that any manufacturer's film will print on any manufacturer's paper. Thus, a measurement of the three primary colour densities of a patch of film will yield information relating to the image dye amounts on the patch of film. A complication to this is that negative films usually include masking dyes as well as image dyes. The effect of non-image dyes may be easily corrected for by measuring, as well as the patch of film in question, the status densities of a patch of unexposed but processed film. The densities so measured may be used to correct the measurements of the exposed processed film to yield information relating to the image dye amounts. The primary colour densities of the unexposed processed film may vary slightly from manufacturer to manufacturer and may therefore need to measured separately for all films to be processed. This is not a great problem, however, since it is current practice to print different manufacturer's films with slightly different settings, the relevant information being stored in the printer.

Having thus obtained from the printer scanner information relating to the total amount of image dye on the image to be copied, it is a simple matter to calculate the depletion of the image-dependent chemicals in the film processor resulting from processing that piece of the film.

Developing agents (or simply "developers" as they are commonly known), such as the family of paraphenylenediamine molecules commonly used in colour photographic processing, are an example of image-dependent chemistry, and it is desirable to replenish the developer according to how much has been used up in forming the dye. By using techniques described in detail in EP-A-0 381 502, the amount of developer which must have been used up can be calculated from a knowledge of the dye amounts formed on the film.

By way of an example to illustrate the process involved in using scan data from the printer to control the film processor solution replenishment, the replenishment of developers will be considered. The key point here is not the exact form of the equations which may need to be changed slightly as process and film formulations change but rather the principle involved, namely that a calculation is possible even if look up tables and empirical data are used.

The film scanner in the printer measures transmittance, in three colours. These measurements depend on the spectral output of the light source as well as the spectral sensitivity of the photodetectors used to effect the measurements. The measured transmittance in each of the three colours, red, green and blue, are known as printing densities and are described fully in Chapter 18 of "*The theory of the photographic process*" published by Macmillan, 4th edition. As described in this reference, printing densities are related to analytical spectral densities by a matrix equation which requires the knowledge of several constants which may be determined by the method described in chapter 18. Analytical densities may then be linearly related to dye amounts in the developed film. Having calculated the dye amounts the procedure is exactly the same as that described in EP-A-0 381 502 for calculating the amount of developer used up to produce the dye amounts. In essence this involves calculating a correction to the manufacturer's recommended average replenishment rate per unit area of film processed, according to the difference from average of the dye amounts on the film. Thus it is possible to derive a relationship between the measured printing densities and the replenishment of the developer. More specifically and more usefully, a relationship between the difference in printing density from average and the correction to the average replenishment rate for the developer may be derived.

Since the technique of adjusting the replenishment rate according to the difference from average of the dye amounts present in the film represents a first order correction to the industry standard practice of replenishing by area, assuming that all film has been exposed to produce average levels of dye, it is not necessary for great accuracy in the calculation of dye amounts etc. Accuracy will inevitably be limited by the errors in delivering precise small quantities of replenisher solution. It is therefore appropriate to simplify calculations by neglecting second order effects and concentrating only on the key parameters. Second order errors will usually average to zero in any case. For example, it is probably unnecessary to use different parameters for each manufacturer's films when calculating replenishment rates. A single look-up table storing typical parameters should be sufficient for all but the most demanding applications. However, when necessary, accurate calculations based on separate parameters for each manufacturer's film are possible using the present invention.

A variant on the technique described in the above example is to replenish once after a batch of prints have been made. For example, it may be appropriate to replenish the developer based on a calculation of the dye amounts present in twelve images on the film. Thus, for every 36-exposure film, three replenishment calculations would be performed and the correct replenishment effected. Equally, it may be appropriate to replenish after several films have been developed based on the sum of the dyes present in the films. The determining factor in deciding how often to replenish is the volume of developer present in the film processor. For large volumes it would be appropriate to replenish less often and vice versa.

Another variant on the present invention is to use a combination of replenishment-by-area and replenishment by calculation. In this case, the film processor would normally replenish by area of film processed until instructed to make a correction by the printer. For example, when the printer had, based on calculation of dye amounts present in the film, accumulated a correction to the normal replenishment rate greater than a threshold level, it would signal to the film processor using a data link, the amount of the correction which needed to be made. This would then be effected at the next replenishment time by adding the correction (either a positive or negative amount) to the usual amount of replenisher dispensed by the replenisher system.

A further small correction may need to be made in the example of replenishing the developer arising from the fact that image dyes are not only present on the image area of the film. Some dye may be produced in the non-image area due to chemical or optical fogging. This is normally so low that the amount would be completely negligible. It may, however, be brought into the calculation by assuming an average fog level and by calculating the amount of dye which would be produced on the non-image areas of the film on an area basis. This avoids the need to explicitly measure the fog level on each film but may lead to errors in cases where films have been severely fogged.

Alternatively, the film scanner may be configured to overscan the image area of the film such that a measure of the actual fog level is obtained. This can be used together with a knowledge of the total area of film which has been processed to infer the actual amount of dye produced in the non-image areas. For the most accurate analysis of the fog levels, the scanner would scan the whole of the film, not just the image areas. It can easily happen that the front or back ends of the film have complete optical fogging due the process of loading the film into the camera. Equally, cameras are occasionally opened by mistake, fogging a section of the film. These events can be fully corrected for if the whole film is scanned.

A variant on the above example, which does not require the scanner to overscan the image area, is to use the scanner to measure the unexposed region between images on the film while the film is being moved from one image to another. A good estimate of the fog level in that region on the film may then be determined. Similarly, it is possible to extend this technique to measure the leading and trailing ends of the film while in motion so that the area of totally fogged film due to camera loading or unloading operations may be estimated. This information, together with the image scan data, will provide all that is necessary for a good estimation of the total dye present on the film in both image and non-image areas, yet without the extra expense of configuring the scanner to overscan the images.

There are several advantages in using printer scan data to control chemical concentrations in the film processor. Firstly, it provides a more accurate way of maintaining optimum conditions in the processor when compared with the current practice of replenishment-by-area alone, especially when the film processor uses small solution volumes.

A further advantage is in the correct replenishment of films which have been exposed in a significantly different manner than usual, for example, totally fogged films where considerably more dye than usual is formed and unexposed films where considerably less is formed.

A yet further advantage is that no extra hardware, save for a link between the printer and the film processor for data transmission, need be provided in that the printer is already equipped with a film scanner which is able to produce the required measurements.

The present invention would be particularly advantageous in an integrated photofinishing machine where film processor, printer and paper processor are built into the same casing. There is no reason, however, why the invention should not be used in a conventional minilab by providing a link between the film processor and the printer through which the scan data could be transmitted.

The above example demonstrates the control of the replenishment of image-dependent chemical species which are depleted according to the amount of dye formed on the film. The method according to the present invention can also be used to control other aspects of the film process and its subsystems such as the removal of image-dependent by-products of the processing reactions or the replenishment of the subsystems which remove image-dependent by-products from the solutions.

For example, halide ions are produced in the developer as a by-product of the development reaction. The quantity of halide ions produced is equal to the amount of silver ions reduced to atomic silver in the developer which is, in turn, related to the amount of dye formed (in colour materials). Since halide ions act as a restrainer for the development reaction, it is desired to keep their concentration at a predetermined level so as to maintain constant processing solution activity.

In this example, the processing apparatus incorporates a subsystem which has the ability of removing halide ions from the processing solution, the ions being removed by passing the processing solution over a coated substrate to which the halide ions bind very strongly. For the purposes of this example, the reaction kinetics are sufficiently fast so that the halide ions are bound to the substrate much faster than they are produced in the developer. For a desired concentration of halide ions in the developer of H moles per liter, and a piece of film which will produce h moles of halide ions (evenly distributed throughout the solution) when processed, the volume of liquid, v, can be calculated for which h moles of halide ions are present and where the total solution volume before development is V. Normally, photographic materials carry out a small amount of liquid with them as they pass from one bath to another, and if it is assumed that the solution volume carried out of the developer by the film is c liters, the following equation is obtained:—

$$v=h(V-c)/(HV+h)$$

If volume, v, of liquid is removed from the developer and passed through the removal system for sufficient time to remove all the halide ions before it is added back into the solution, the halide concentration in the developer may be kept constant. The parameters H, V and c are known constants and h may be calculated from a knowledge of the dye amounts formed on the film, and hence v may be calculated. Thus a flow controller may be operated to dispense v liters of liquid into the halide removal system. This example demonstrates how printer scan information can be used to control the operation of a removal system in the film processor.

It is noted that h is a function of the exposure given to the material, and may be determined form the sensitometric data relating to the film which is stored in the processing apparatus. Specifically, the relation between exposure and developed silver would be used, since the number of halide ions released into the developer solution is identical to the number of silver ions developed to form metallic silver.

If the capacity of the removal system is R moles of halide ions, it is a simple matter to predict when it will be exhausted. If T is the volume of solution which can be treated:—

$$T=Rv/h$$

Thus the operator may be automatically alerted when action needs to be taken to change or replenish a removal system cartridge.

In all the discussion above, the exact form of the relation between halide ions released and dye amounts is not the key issue, as it merely serves to illustrate the principle that a calculation is possible. Neither is it necessary to use a "batch type" removal system as described above. A more complicated, continuous flow system may be used, provided its characteristics are well-known and that accurate flow-measurement is possible.

Furthermore, the exact relation between dye amounts and the amount of any by-product generated during processing may be determined experimentally using techniques familiar to any one skilled in the art of printing and processing. Look-up tables of this empirical data may then be used by the control system of the processing machine to control the removal subsystems built into it.

The method according to the present invention is applicable to any removal system used in photographic processing apparatus whether it be based on chemical binding, as above, or ionic replacement as in ion-exchange columns and silver recovery cartridges or any other method where an element of the system is either exhausted or needs replenishing with reagent.

This method has the advantage that an indication can be given to an operator when a removal system is nearly exhausted. This enables maintenance to be carried out at the right time and without the need for routine measurements by the operator. Sometimes it is very difficult for an unskilled operator to make these measurements especially where they are concerned with effluent discharge limits which may be very low.

Another advantage of this method is that automatic replenishment of the consumable components of the removal systems may be achieved such that the removal efficiency of the systems is maintained at a constant level.

For example, a liquid reagent which reacts strongly with the halide ions may have been chosen to cause the ions to precipitate out of the solution as an alternative to using a solid substrate to which the halide ions bind. In this case, the removal system may comprise a separate reaction vessel in which known amounts of developer solution are added to the liquid reagent. It is clear that the liquid reagent would need replenishing from time to time in order to keep its activity high. This replenishment could be controlled by knowing the amount of reagent used up in removing the halide ions. This amount is related to the amount of halide ions to be removed which, in turn, may be calculated from the amount of exposure given to the photographic material which released the halide ions.

In the above example, the liquid reagent is the consumable component of the removal system.

Therefore, it can be seen that in addition to controlling the operation of removal systems for image-dependent chemical species, the present invention may also be used to control the replenishment of the removal system itself.

In the case of non-replenished removal systems, the present invention can be used to predict exhaustion of the removal system and provide a signal to alert an operator or an automatic system to take the necessary maintenance actions. For example, in an automatic system, the signal may cause an actuator to switch the liquid flow from a nearly-exhausted removal system to a fully replenished system connected in parallel.

Furthermore, control of the concentration of components of the process produced as by-products of chemical reactions which are image-related can be provided without the need for chemical sensors being present in the processing solution.

Moreover, for chemical species for which no convenient chemical sensor exists, the method of the present invention makes process and environmental control possible for the first time.

In all the above examples, nothing has been explicitly stated about the resolution of the film scanner. It can be shown that if the variation in the dye amount across the image is small, a large area measurement will give the same results in calculating dye amounts present in the image as summing the calculations made on a large number of smaller areas within the negative. Such a higher resolution measurement would be possible where printer scanners are equipped with a multipixel scanner. It can, however, be shown that where variations in dye amount are large in comparison with the average, a small error will be introduced, so as to slightly underestimate the total dye amount. Thus a more accurate calculation is achieved when a high resolution scan of the image is performed especially where the resolution is of the same order as the length scale of the dye amount variations.

Under normal circumstances, this is not a serious error, since the replenishment control will usually be implemented as making a correction to the average amount of replenisher dispensed per unit area of film processed, the average being determined by manufacturer's recommendations. The average will normally be such as to correct on average for the errors introduced by low-resolution scanning and in any case such errors represent a small second order correction.

Another possible application of the present invention concerns the use of scanners for different display media other than photographic prints. For example, some customers of photofinishing laboratories may prefer not to have a set of photographic copies of their film images on paper but stored on an optical or magnetic storage device for subsequent electronic display on a television monitor. Journalists also may not require hard copy of their film images but may prefer to scan their images and transmit them electronically to another location. In these two examples, the image would still need to be scanned just as in a photographic printer. Thus the present invention would still apply, in that the measured transmittance data from the images could be used to calculate the amount of image producing substances on the image for the purpose of controlling the replenishment of chemical species in the film processor.

I claim:

1. A method of controlling the chemical activity of processing solutions used in a photographic processing apparatus, the apparatus comprising a film processing stage in which an exposed photographic film is processed and a subsequent second stage including measuring means for measuring the optical transmittance of an image on the film, the method including the step of measuring the transmittance of the image, and using the measured transmittance information for converting the image into a desired format in said subsequent second stage, characterized by the step of controlling the removal of by-products formed in the film processing stage and its attached subsystems in response to the transmittance information to maintain concentration of said by-products at a predetermined level.

2. A method according to claim 1, wherein a signal directly relating to the amount of image-forming substances on the image to be converted is derived from the measured transmittance and is used to calculate the amount of by-products produced during the film processing stage.

3. A method according to claim 2, wherein the signal is derived from measurements of the average transmittance of the image to be converted.

4. A method according to claim 2, wherein the signal is derived from measurements of the average transmittance of a plurality of different small areas of the image to be converted.

5. A method according to claim 2, wherein the signal is derived from the sum of measurements of a batch of images to be converted.

6. A method according to claim 2, wherein the signal includes data relating to the sensitometric characteristics of the film.

7. A method according to claim 1, wherein the by-products are ions.

8. A method according to claim 1, wherein the by-products are halide ions.

9. A method according to claim 1, wherein the by-products are molecules.

10. A method according to claim 9, wherein the molecules are oxidized developer molecules.

11. A method according to claim 1, wherein a removal system is provided for the removal of by-products, said removal system comprising a consumable component which is used for removal of the by-products, further comprising the step of using said transmittance information for controlling replenishment of said consumable component to maintain removal efficiency of said removal system at a constant level.

12. A method according to claim 11, wherein said transmittance information is used to calculate the level of depletion of the consumable components.

13. A method according to claim 12, wherein the calculated level is used to provide a signal to indicate near-exhaustion of the consumable components.

14. A method according to claim 13, wherein the signal indicating near-exhaustion is used to switch between the nearly exhausted system and another fully replenished removal system provided in parallel.

* * * * *